US006971280B2

(12) United States Patent
Mayr

(10) Patent No.: US 6,971,280 B2
(45) Date of Patent: Dec. 6, 2005

(54) CAM MECHANISM ON A FOLDING CYLINDER

(75) Inventor: Peter Mayr, Todtenweis (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 183 days.

(21) Appl. No.: 10/318,771

(22) Filed: Dec. 13, 2002

(65) Prior Publication Data

US 2003/0110966 A1 Jun. 19, 2003

(30) Foreign Application Priority Data

Dec. 13, 2001 (DE) ..... 101 61 400

(51) Int. Cl.[7] ..... F16H 53/06; F16H 53/00; B41F 13/24; B65H 29/06

(52) U.S. Cl. ..... 74/569; 74/567; 101/232; 270/43; 271/82

(58) Field of Search ..... 74/567, 569, 568 R, 74/570, 571 L; 101/232; 270/43; 271/82, 271/314; B65H 29/06; B41F 13/64

(56) References Cited

U.S. PATENT DOCUMENTS 4,098,187 A * 7/1978 Wirz ..... 101/410
4,332,582 A 6/1982 Hertrich
4,535,691 A * 8/1985 Kida ..... 101/230
4,892,036 A 1/1990 Lange ..... 101/240
5,048,366 A * 9/1991 Spanio ..... 74/567
6,557,844 B2 * 5/2003 Becker et al. ..... 271/82
2001/0033784 A1 10/2001 Becker et al.

FOREIGN PATENT DOCUMENTS

| | | | |
|---|---|---|---|
| CH | 210096 | 9/1940 | |
| DD | 1810294 | 10/1969 | |
| DE | 3810439 C1 | 8/1989 | ..... B41F 13/62 |
| DE | 196 51 769 A1 | 6/1998 | ..... B41F 13/62 |
| DE | 101 13 165 A1 | 10/2001 | |
| DE | 010320760 A1 * | 12/2003 | ..... 74/569 |
| GB | 2 291 409 | 1/1996 | ..... B65H 45/16 |

OTHER PUBLICATIONS

Merriam Webster's Collegiate Dictionary, Tenth Edition, 1999, p. 452.*

* cited by examiner

*Primary Examiner*—Vinh T. Luong
(74) *Attorney, Agent, or Firm*—Cohen, Pontani, Lieberman & Pavane

(57) ABSTRACT

A cam mechanism for a folding cylinder or gripping cylinder of a printing machine have a cam disk assembly with two cam disks located adjacent to one another. The cam mechanism has good kinematic properties and is subject to low wear, the outer casing of the cam roller has two convex curvatures arranged adjacent to one another and running circumferentially around the cam roller, each curvature co-operating with one of the cam disks.

6 Claims, 2 Drawing Sheets

CAM MECHANISM ON A FOLDING CYLINDER

BACKGROUND OF THE INVENTION

1. Field of the Invention

The invention relates to a cam mechanism on a folding cylinder having a cam disk assembly on which a cam roller runs, the cam disk assembly including first and second cam disks which are arranged coaxially adjacent to one another and are rotatable relative to one another.

2. Description of the Related Art

Folding cylinders for folders of web-fed rotary printing machines include working elements such as, for example, bodkins, folding flaps or grippers, that are controlled by cam mechanisms for receiving and discharging products. The reception of a product may also be selectively stopped or prevented. The cam mechanism includes a cam disk assembly having first and second cam disks which are arranged coaxially next to one another. In the event that no product is to be taken off, one of the first and second cam disks is rotated such that it covers a control region of the other of the first and second cam disks. A width of a cam roller of the cam mechanism is designed such that the cam roller covers both the first and second cam disks. The outer contour of the cam roller is crowned to compensate an edge run in the event of skewing.

One disadvantage of this prior art cam mechanism is that the crowned cam roller rests mainly in the region between the two cam discs in which they are adjacent to one another. This may cause the edges of the disks to break off. Moreover, the edges are deburred by hand and have a correspondingly irregular coarse surface which gives rise to pronounced wear on the cam roller.

Instead of one cam roller covering both cam disks, two cam rollers may be used in which each cam roller is assigned to a respective cam disk. However, these two cam rollers entail a greater overall mass and correspondingly produce adverse inertia forces during rotation of the folding cylinder. Moreover, if the axis of rotation of the roller lever is bent out, one of the cam rollers is lifted off the cam disks to a greater extent and causes a jolt when the lifted cam roller is subsequently put into place. Furthermore, a cam roller stops or slows its rotational speed when it has been lifted off from the cam disk to which it is assigned. When it is placed on the cam disk again, the cam roller has to be accelerated, this being accompanied by jolts and slip which cause wear.

SUMMARY OF THE INVENTION

The object of the present invention is to provide a cam mechanism for a folding cylinder which has good kinematic properties and is subject to low wear.

The object of the present invention is achieved by a cam roller having an outer contour with two convex curvatures adjacent to one another and running circumferentially around the cam roller. The two convex curvatures define a depression therebetween on the cam roller. Each convex curvature on the outer contour cooperates with a respective one of two cam disks. The depression defined between the two convex curvatures is aligned with a region between the two cam disks.

The proposed cam roller is distinguished by a low mass which aids in minimizing the corresponding kinematic forces. Moreover, an edge run of the cam roller on the cam disks is avoided by the convex curvatures. Also, the cam roller runs with each of its curvatures along a middle region of the associated one of the two cam disks so that the edges of the cam disks are not damaged and so that the cam roller is not damaged by the edges. Moreover, the cam roller of the present invention may be designed with a narrower design than an embodiment using two separate cam rollers so that the lift-off of a convex curvature is minimized in the event that the roller-lever axis is bent out. Finally, even when it crosses over a low-lying region of one of the cam disks, the cam roller is maintained at rotational speed by contact with the other cam disk and there is therefore no need for subsequent acceleration with accompanying jolts and frictional slip.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
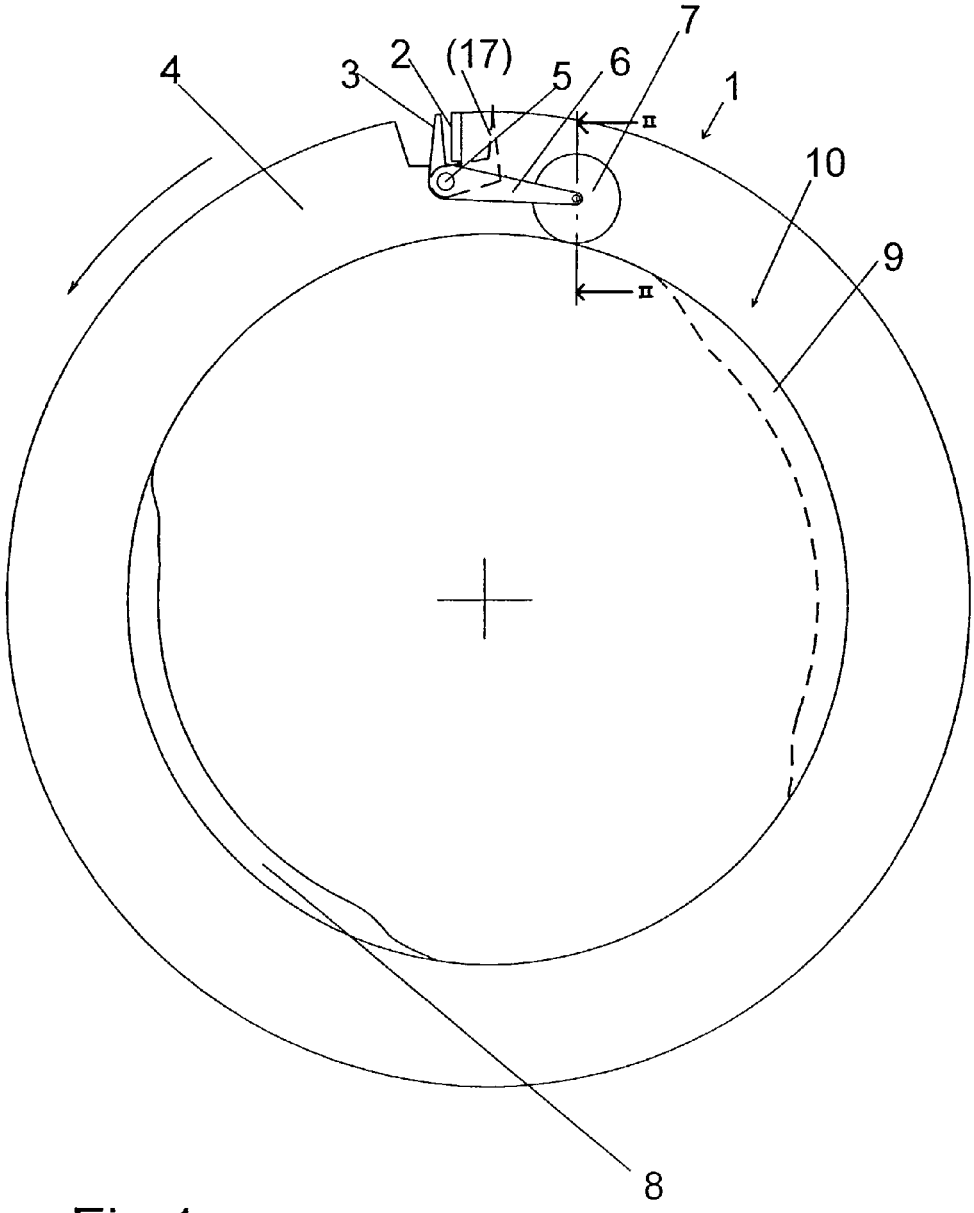
FIG. 1 is a schematic side view of a cam mechanism on a folding-flap cylinder according to of the present invention.

A folding-flap cylinder 1 having a cylinder body 4 is shown in a side view in FIG. 1 with a fixed folding flap 2 and a controlled folding flap 3 arranged thereon. The controlled folding flap 3 is fastened on an axis 5 mounted rotatably in a cylinder body 4. Furthermore, a roller lever 6 having a cam roller 7 attached thereto is fastened on the axis 5. During the rotation of the folding-flap cylinder 1, a cam roller 7 attached to the roller lever 6 runs on first and second cam disks 8, 9 of a cam disk assembly 10. The first and second cam disks 8, 9 are arranged coaxially, adjacent to one another and rotatable relative to one another. The first cam disk 8 may be arranged fixedly relative to a stand (not shown) which supports the folding cylinder 1 and the second disc 9 is rotatable relative to the first disc 8 by means which are also not shown.

Figure 2:
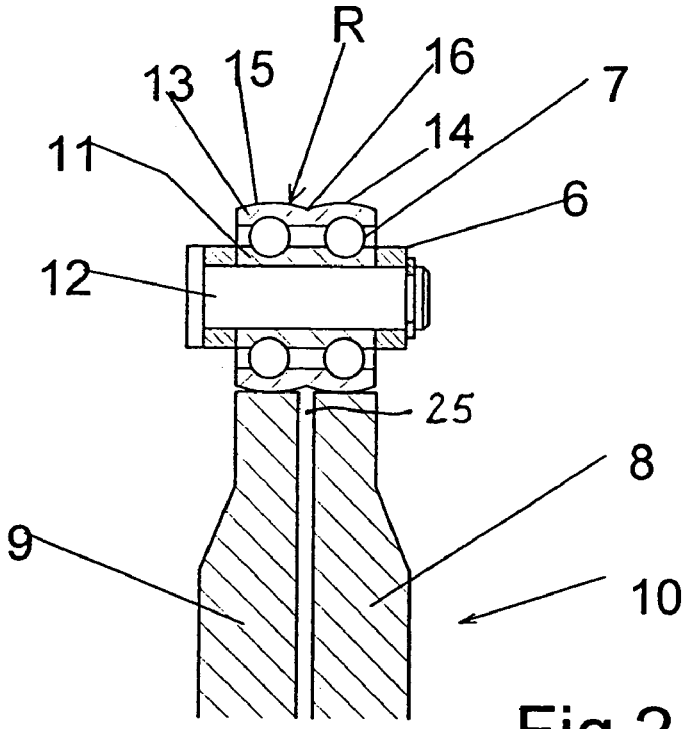
FIG. 2 is a sectional view through line II—II according to FIG. 1.

As shown in FIG. 2, the cam roller 7 is a rolling bearing and the roller lever 6 as a forked lever. An inner ring 11 of the cam roller 7 is mounted on a roller bolt 12 inserted into the roller lever 6. An outer ring 13 of the cam roller 7 carries two convex curvatures 14, 15 on the outer casing adjacent to one another and running around in the circumferential direction. Each curvature 14, 15 cooperates with one of the cam disks 8, 9. A depression 16 defined between the convex curvatures 14, 15 rests above the region 25 between the cam disks 8, 9 in which they are adjacent to one another. Each convex curvature 14, 15 may designed as an arc of a circle, the radius R of which has been selected within the range of $300\ \text{mm} \leqq R \leqq 600\ \text{mm}$. However, the convex curvatures may also be designed as other types of geometric curves.

During the rotation of the folding-flap cylinder 1 in the direction indicated by the arrow in the upper left section of FIG. 1, the cam roller 7 runs, i.e., rolls, on the cam disks 8, 9. When the cam disk 9 is in the position shown in FIG. 1, the cam roller is prevented from entering into the valley of the disk 8 and the controlled folding flap 3 remains open. When the cam disk 9 is rotated so that the valleys of both cam disks 8, 9 are in congruence, i.e., overlap, the cam roller 7 penetrates into these valleys and the folding flap 3 is closed by the movement of lever 6 about the axis 5.

Bodkins or grippers may also be controlled by the cam mechanism described herein. A bodkin strip 17, shown in broken lines in FIG. 1, may be fastened on the axis instead of the folding flap 3. The bodkin strip 17 is indicated by a bracketed reference.

Figure 3:
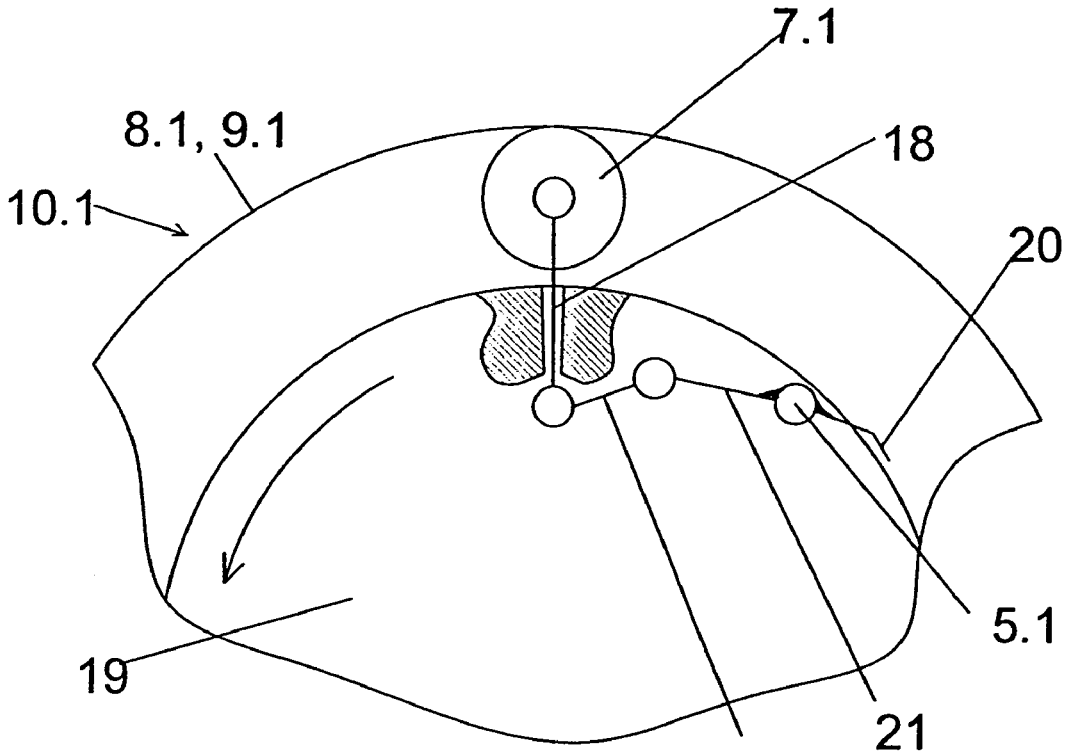
FIG. 3 is a partial schematic side view of a further embodiment of a cam mechanism.

The cam roller 7 may also be fastened to a tappet 18 which is straight-guided in a folding cylinder. According to FIG. 3, a gripper cylinder 19 carries a gripper strip 20 which is connected on an axis 5.1 mounted rotatably in the gripper cylinder 19. Furthermore, a lever 21 is also fastened on the axis 5.1 and is drive-connected to the tappet 18 by a link 22. A cam roller 7.1 co-operates with a cam disk assembly 10.1 which is designed as an inner cam, i.e., the cam surfaces face radially inward. The cam disk assembly 10.1 includes first and second cam disks 8.1, 9.1 which are designed similarly to cam disks 8 and 9 of the previous exemplary embodiment and are rotatable relative to one another. The cam roller 7.1 likewise has contours in the outer casing which are similar to those of the cam roller 7 described above.

During rotation of the gripper cylinder 19, the cam roller 7.1 runs on the cam disks 8.1 and 9.1. When the recesses or valleys (not shown in FIG. 3) of the cam disks 8.1, 9.1 have been brought into congruence, the cam roller 7.1 together with the tappet 18 moves radially into the valley. The movement of the cam roller 7.1 and tappet 18 into the valley is translated into a closing movement of the grippers of the gripper strip 20 by the link 22 and lever 21.

While only one roller lever 6 and tappet 18 is shown, a plurality of roller levers 6 or tappets 18, which co-operate with a cam disk assembly 10, 10.1 may be arranged on a folding cylinder or gripping cylinder 1, 19.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A cam mechanism on a cylinder for a web-fed rotary printing machine, comprising:

a cam disk assembly including first and second cam disks arranged coaxially, adjacent to one another and rotatable relative to one another; and a cam roller operatively connected to the cylinder for running on said cam disk assembly during rotation of the cylinder, said cam roller having an outer casing with two convex curvatures arranged adjacent to one another for respectively cooperating with said first and second cam disks, said convex curvatures running circumferentially around said cam roller and defining a depression therebetween, said depression substantially aligned with a region between said first and second cam disks, wherein the cylinder is a bodkin/folding-knife cylinder having a bodkin strip pivotal about an axis, said cam roller being drive-connected to said axis of said bodkin strip.

2. The cam mechanism of claim 1, wherein said cam roller is mounted on a roller lever that is operatively connected to the cylinder.

3. The cam mechanism of claim 1, wherein said cam roller is mounted on a tappet connectable to the cylinder.

4. The cam mechanism of claim 1, wherein each of said convex curvatures is a circle arc.

5. The cam mechanism of claim 1, wherein each of said convex curvatures is a geometric curve.

6. The cam mechanism of claim 1, wherein the cam disc are inner cams.

* * * * *